US009929454B2

(12) United States Patent
Ushijima et al.

(10) Patent No.: US 9,929,454 B2
(45) Date of Patent: Mar. 27, 2018

(54) CIRCULARLY POLARIZED WAVE GENERATOR

(71) Applicant: Mitsubishi Electric Corporation, Tokyo (JP)

(72) Inventors: Yu Ushijima, Tokyo (JP); Hidenori Yukawa, Tokyo (JP); Tetsu Owada, Tokyo (JP); Shuji Nuimura, Tokyo (JP)

(73) Assignee: Mitsubishi Electrics Corporation, Tokyo (JP)

( * ) Notice: Subject to any disclaimer, the term of this patent is extended or adjusted under 35 U.S.C. 154(b) by 0 days.

(21) Appl. No.: 15/129,466

(22) PCT Filed: Apr. 2, 2015

(86) PCT No.: PCT/JP2015/060477
§ 371 (c)(1),
(2) Date: Sep. 27, 2016

(87) PCT Pub. No.: WO2015/182243
PCT Pub. Date: Dec. 3, 2015

(65) Prior Publication Data

US 2017/0170571 A1 Jun. 15, 2017

(30) Foreign Application Priority Data

May 30, 2014 (JP) ..... 2014-113012

(51) Int. Cl.
*H01P 1/17* (2006.01)
*H01Q 15/24* (2006.01)
(Continued)

(52) U.S. Cl.
CPC ..... *H01P 1/171* (2013.01); *H01P 1/17* (2013.01); *H01P 1/182* (2013.01); *H01P 3/12* (2013.01); *H01Q 13/06* (2013.01); *H01Q 15/244* (2013.01)

(58) Field of Classification Search
CPC .. H01P 1/163; H01P 1/17; H01P 1/182; H01P 3/12; H01P 1/171; H01Q 15/244; H01Q 13/06
(Continued)

(56) References Cited

U.S. PATENT DOCUMENTS 6,118,978 A 9/2000 Ihmels
7,009,464 B1 3/2006 Patel
(Continued)

FOREIGN PATENT DOCUMENTS

JP 2004-266501 A 9/2004
WO 99/67848 A1 12/1999

OTHER PUBLICATIONS

Written Opinion issued in PCT/JP2015/060477; dated May 19, 2015.

(Continued)

*Primary Examiner* — Robert J Pascal
*Assistant Examiner* — Jorge Salazar, Jr.
(74) *Attorney, Agent, or Firm* — Studebaker & Brackett PC

(57) ABSTRACT

A circularly polarized wave generator includes a rectangular hollow waveguide (1), a plurality of first protrusions (2) that are provided on one pair of opposing wall surfaces in the waveguide (1), have longitudinal directions orthogonal to an axial direction of the waveguide (1), and are arranged at intervals along the axial direction, and a plurality of second protrusions (3) that are provided between the first protrusions (2) on the wall surfaces and are arranged with longitudinal directions thereof running along the axial direction.

9 Claims, 5 Drawing Sheets

(51) Int. Cl.
*H01Q 13/06* (2006.01)
*H01P 1/18* (2006.01)
*H01P 3/12* (2006.01)

(58) Field of Classification Search
USPC ..... 333/21 A, 157
See application file for complete search history.

(56) References Cited

U.S. PATENT DOCUMENTS

| | | | | |
|---|---|---|---|---|
| 8,598,960 | B2 * | 12/2013 | Blaser | H01P 1/171 333/208 |
| 2002/0171596 | A1 | 11/2002 | Em et al. | |
| 2011/0133863 | A1 * | 6/2011 | Lange | H01P 1/171 333/21 A |

OTHER PUBLICATIONS

International Search Report issued in PCT/JP2015/060477; dated May 19, 2015.

Ushijima et al.; A Study of Short Axial-length Rectangular Waveguide Polarizer with Low Axial Ratio; Proceedings of the Society Conference of IEICE; Sep. 2014; pp. 79.

Asao et al.; 20/30GHz-band Metal-Plated Plastic Corrugated Waveguide Polarizer: Institute of Electronics, Information, and Communication Engineers; NII-Electronic Library service; 2003; pp. 75.

Communication Pursuant to Rules 70(2) and 70a(2) EPC issued by the European Patent Office on Oct. 12, 2017, and the extended European search report issued by the European Patent Office dated Sep. 25, 2017, which correspond to EP15800142.0-1927 and is related to U.S. Appl. No. 15/129,466.

Tuchiolke et al., "Field Theory Design of Square Waveguide Iris Polarizers", IEEE Transactions on Microwave Theory and Techniques, Jan. 1, 1986, pp. 156-160, vol. MTT-34, No. 1, New York, USA.

Hwang et al., "New Design Method for a Dual band Waveguide Iris Polarizer", IEEE 2007 International Symposium on Microwave, Antenna, Propagation, and EMC Technologies for Wireless Communications, Aug. 1, 2007, pp. 435-438.

Tribak et al., "Ultra-Broadband Low Axial Ratio Corrugated Quad-Ridge polarizer", Proceedings of the 39th European Microwave Conference, Sep. 29, 2009, pp. 73-76, Piscataway, NJ, USA.

* cited by examiner

CIRCULARLY POLARIZED WAVE GENERATOR

TECHNICAL FIELD

The present invention relates to a circularly polarized wave generator capable of obtaining preferable frequency characteristics of a passing phase difference between polarized waves over a wide band in a microwave band or a millimeter wave band.

BACKGROUND ART

A microwave signal is mainly used in communications of satellite communication equipment, base stations of cellular phones and the like, and one of devices used in processing of the microwave signal is a circularly polarized wave generator. The circularly polarized wave generator converts a linearly polarized wave into a circularly polarized wave and, as a well-known configuration thereof, there is a corrugated circularly polarized wave generator (see, e.g., Patent Document 1).

The corrugated circularly polarized wave generator disclosed in Patent Document 1 is a rectangular waveguide, and a plurality of pleat-like protrusions (corrugates) orthogonal to an axial direction are arranged at predetermined intervals in the axial direction on opposing wall surfaces. In addition, the heights of the individual protrusions are varied such that an envelope represented by the tips of the protrusions forms a smooth quadratic or cubic Cos curve with the center in the axial direction serving as the vertex. With the arrangement of the protrusion described above, a passing phase difference occurs between two linearly polarized waves (V-polarized wave, H-polarized wave) input to the circularly polarized wave generator that are orthogonal to each other, and the linearly polarized waves are converted into a circularly polarized wave (clockwise wave, counterclockwise wave) in a predetermined frequency band.

CITATION LIST

Patent Document

Patent Document 1: Japanese Patent Application Laid-open No. 2004-266501

SUMMARY OF THE INVENTION

Problems to be Solved by the Invention

The conventional circularly polarized wave generator is configured as described above, and preferable frequency characteristics of the passing phase difference between polarized waves are realized over a wide band by gradually varying the heights of the protrusions in the axial direction. However, when the heights of the protrusions are gradually varied, an absolute passing phase difference between polarized waves per protrusion is reduced. Accordingly, the number of stages of the protrusions is increased in correspondence to desired frequency characteristics of the passing phase difference between polarized waves, and the axial length is increased. On the other hand, when the axial length is reduced, the heights of the protrusions are sharply varied in the axial direction, and hence it is difficult to realize preferable frequency characteristics of the passing phase difference between polarized waves. Consequently, there has been a problem that, only by varying the heights of the protrusions, it is difficult to achieve both of a reduction in the axial length of the waveguide and preferable frequency characteristics of the passing phase difference between polarized waves over a wide band.

The present invention has been made in order to solve the above problem, and an object thereof is to provide the circularly polarized wave generator capable of obtaining preferable frequency characteristics of the passing phase difference between polarized waves over a wide band without increasing the axial length of the waveguide.

Means for Solving the Problems

A circularly polarized wave generator according to the present invention includes a rectangular hollow waveguide, a plurality of first protrusions that are provided on one pair of opposing wall surfaces in the waveguide, have longitudinal directions orthogonal to an axial direction of the waveguide, and are arranged at an interval along the axial direction, and a plurality of second protrusions that are provided between the first protrusions on the wall surfaces and are arranged with longitudinal directions thereof running along the axial direction.

Effect of the Invention

According to the present invention, since the above configuration is adopted, preferable frequency characteristics of the passing phase difference between polarized waves are obtained over a wide band without increasing the axial length of the waveguide.

BEST MODE FOR CARRYING OUT THE INVENTION

Hereinbelow, embodiments of the present invention will be described in detail with reference to the drawings.

Embodiment 1

Figure 1:
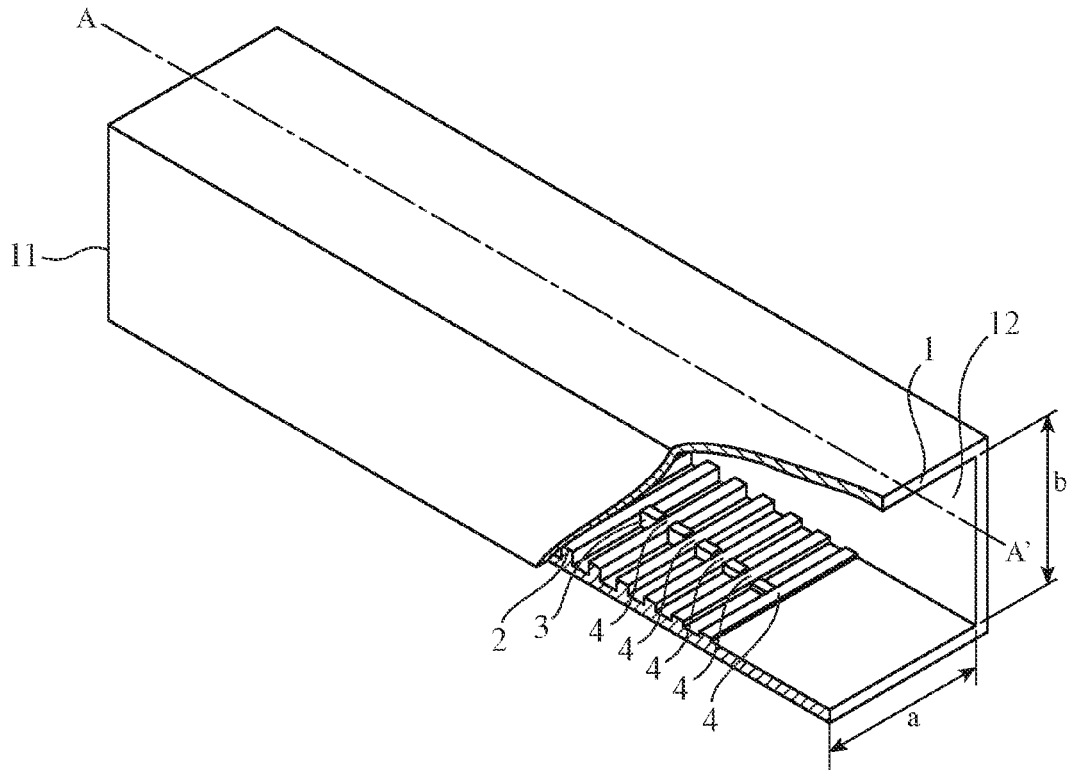
FIG. 1 is a perspective view showing a configuration of a circularly polarized wave generator according to Embodiment 1 of the invention in which a part is removed.
Figure 2:
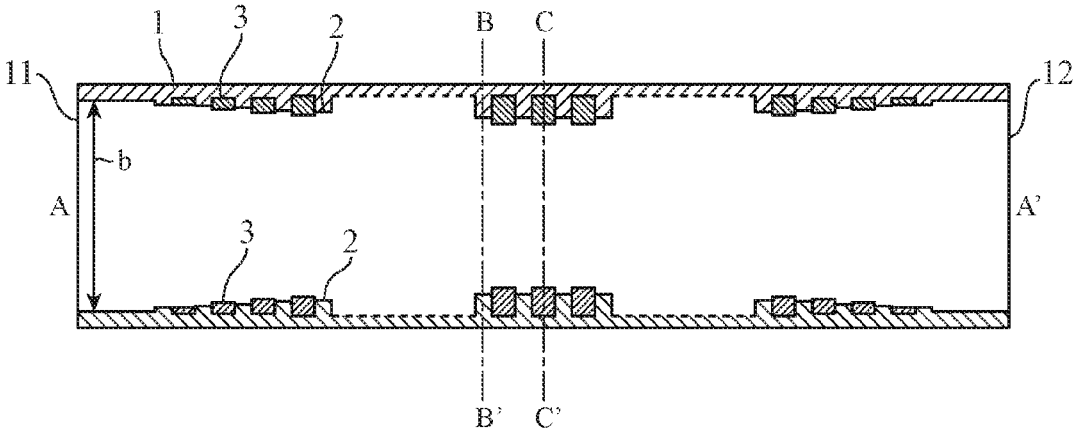
FIG. 2 is a cross-sectional view taken along the line A-A' of FIG. 1.
Figure 3:
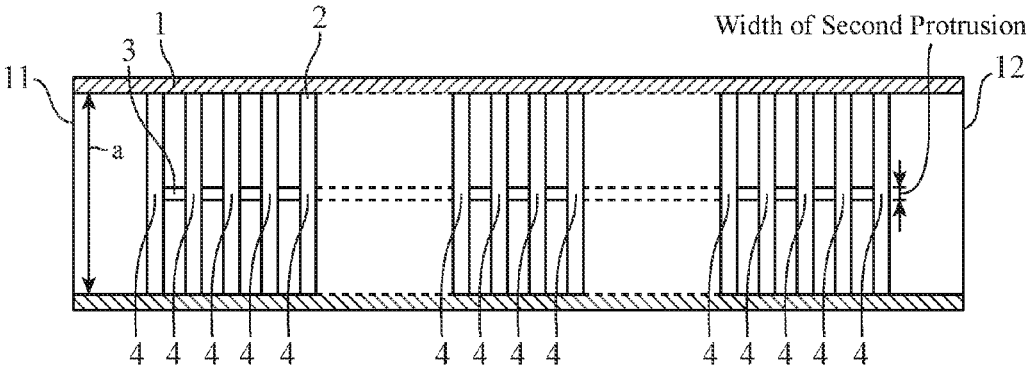
FIG. 3 is a top view showing the configuration of the circularly polarized wave generator according to Embodiment 1 of the invention in which an upper surface is removed.
Figure 4A:
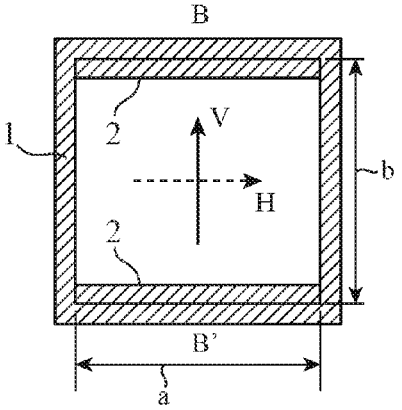
FIGS. 4(*a*) and 4(*b*) are views showing the configuration of the circularly polarized wave generator according to Embodiment 1 of the invention, and FIG. 4(*a*) is a cross-sectional view taken along the line B-B' of FIG. 2 and FIG. 4(*b*) is a cross-sectional view taken along the line C-C' of FIG. 2.
Figure 4B:
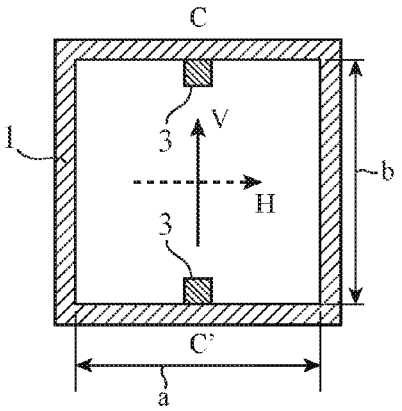
Figure 5:
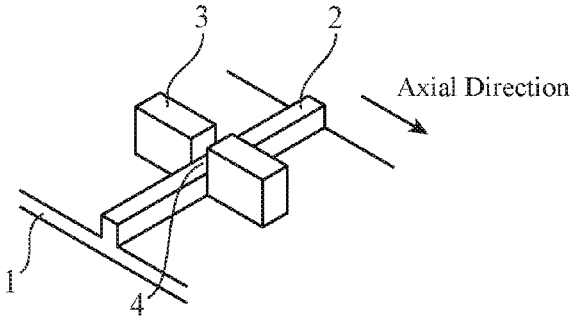
FIG. 5 is an enlarged view showing configurations of a first protrusion and a second protrusion in Embodiment 1 of the invention.

FIG. 1 is a perspective view showing a configuration of a circularly polarized wave generator according to Embodiment 1 of the invention in which a part is removed, FIG. 2 is a cross-sectional view taken along the line A-A' of FIG. 1, FIG. 3 is a top view in which an upper surface is removed, FIG. 4(*a*) is a cross-sectional view taken along the line B-B' of FIG. 2, FIG. 4(*b*) is a cross-sectional view taken long the line C-C' of FIG. 2, and FIG. 5 is an enlarged view showing configurations of a first protrusion 2 and a second protrusion 3.

The circularly polarized wave generator converts a linearly polarized wave into a circularly polarized wave. As shown in FIG. 1, the circularly polarized wave generator includes a waveguide 1, first protrusions 2, and second protrusions 3.

The waveguide 1 is a rectangular hollow waveguide. Note that, in FIG. 1, reference numerals 11 and 12 denote opening ends of the waveguide 1. In addition, in Embodiment 1, as shown in FIGS. 4(*a*) and 4(*b*), each of the opening ends 11 and 12 of the waveguide 1 is formed into a square (a:b=1:1).

The first protrusions 2 are protrusions that are provided on one pair of opposing wall surfaces (upper and lower surfaces in the drawing) in the waveguide 1, have longitudinal directions orthogonal to an axial direction of the waveguide 1, and are arranged at intervals along the axial direction.

The second protrusions 3 are protrusions that are provided between the first protrusions 2 on the wall surfaces in the waveguide 1 and are arranged with longitudinal directions thereof running along the axial direction of the waveguide 1.

Note that, in FIG. 1, reference numerals 4 denote points (intersection points) at which the first protrusions 2 and the second protrusions 3 intersect each other. In addition, the drawing shows the case where each intersection point 4 of the first protrusion 2 and the second protrusion 3 is positioned on the central axis of the waveguide 1. Thus, by positioning the intersection point 4 on the central axis of the waveguide 1, a basic mode of a V-polarized wave has a symmetric distribution, and it is possible to effectively lower a cutoff frequency of the basic mode of the V-polarized wave.

Further, as shown in FIG. 2, the heights of the individual first and second protrusions 2 and 3 are configured such that each of envelopes represented by the tips of the first and second protrusions 2 and 3 forms a smooth quadratic or cubic Cos curve with the center of the waveguide 1 in the axial direction serving as the vertex.

Next, the operation of the thus configured circularly polarized wave generator will be described with reference to FIGS. 1 to 5. In the following description, as shown in FIGS. 4(*a*) and 4(*b*), it is assumed that each of the opening ends 11 and 12 of the waveguide 1 is formed into the square. In addition, in FIGS. 4(*a*) and 4(*b*), a polarized wave indicated by a solid line arrow is a V-polarized wave, while a polarized wave indicated by a broken line arrow is an H-polarized wave. The V-polarized wave and the H-polarized wave are in a relationship orthogonal to each other. Further, as shown in FIGS. 2 and 5, it is assumed that the height of the second protrusion 3 is higher than the height of the first protrusion 2.

First, consideration will be given to the case where the V-polarized wave has been input from the opening end 11 of the circularly polarized wave generator.

The V-polarized wave input from the opening end 11 passes through a waveguide having a cross-sectional shape with the first protrusion 2 shown in FIG. 4(*a*) and a waveguide having a cross-sectional shape with the second protrusion 3 shown in FIG. 4(*b*) alternately.

At this point, with regard to the waveguide having the cross-sectional shape shown in FIG. 4(*a*), in general, the length thereof in the axial direction is short, and hence the first protrusion 2 functions as a capacitive susceptance, and delays the passing phase of the V-polarized wave. Further, with regard to the waveguide having the cross-sectional shape shown in FIG. 4(*b*), the waveguide functions as what is called a ridge waveguide, and the second protrusion 3 increases the electrical length of the waveguide through which the V-polarized wave passes. Accordingly, the passing phase of the V-polarized wave in the waveguide in FIG. 4(*b*) relatively lags behind the H-polarized wave.

Next, consideration will be given to the case where the H-polarized wave has been input from the opening end 11 of the circularly polarized wave generator.

The H-polarized wave input from the opening end 11 also passes through the waveguide having the cross-sectional shape with the first protrusion 2 shown in FIG. 4(*a*) and the waveguide having the cross-sectional shape with the second protrusion 3 shown in FIG. 4(*b*) alternately.

At this point, with regard to the waveguide having the cross-sectional shape shown in FIG. 4(*a*), in general, the length thereof in the axial direction is short, and hence the first protrusion 2 functions as an inductive susceptance, and advances the passing phase of the H-polarized wave. Further, with regard to the waveguide having the cross-sectional shape shown in FIG. 4(*b*), the second protrusion 3 is disposed in a direction perpendicular to an electric field, and hence an influence of the second protrusion 3 on the passing phase of the H-polarized wave is small.

As mentioned above, not only with the first protrusion 2 functioning as the capacitive and inductive susceptances but also with the second protrusion 3, the passing phase difference occurs between the V-polarized wave and the H-polarized wave, and the circularly polarized wave is output from the opening end 12. Accordingly, as compared with the conventional configuration that uses only the first protrusion 2, it is possible to increase the passing phase difference between polarized waves. Consequently, by properly selecting the dimensions of the first and second protrusions 2 and 3, it is possible to obtain preferable characteristics of the passing phase difference between polarized waves over a wide band without increasing the axial length of the waveguide 1.

Figure 6:
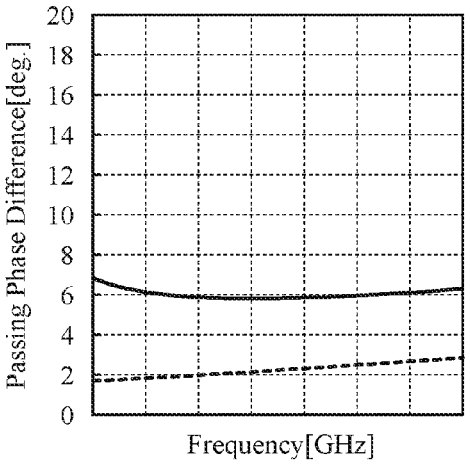
FIG. 6 is a graph showing effects of the circularly polarized wave generator according to Embodiment 1 of the invention.

Herein, the effectiveness of the present invention will be described by taking the passing phase difference between polarized waves per configuration that uses the first and second protrusions 2 and 3 shown in FIG. 5 as an example. FIG. 6 is a characteristic diagram in which the frequency characteristic of the passing phase difference between the V-polarized wave and the H-polarized wave per first protrusion 2 (broken line) is compared with the frequency characteristic of the passing phase difference between the V-polarized wave and the H-polarized wave per configuration that uses the first and second protrusions 2 and 3 (solid line). Note that these characteristics are determined using equivalent circuit calculation.

As shown in FIG. 6, in contrast to the case where only the first protrusion 2 is used, in the case of the configuration that uses the first and second protrusions 2 and 3, it can be seen that the frequency deviation of the passing phase difference between polarized waves is small, and it is possible to realize a large absolute passing phase difference amount. That is, by arranging a plurality of the first and second protrusions 2 and 3 in the axial direction and properly selecting the dimensions thereof, preferable passing phase difference characteristics are obtained over a wide band without increasing the axial length of the waveguide 1.

Note that FIG. 6 is an example, and the above effectiveness is similarly obtained in Embodiment 1 and Embodiments described later.

Figure 7:
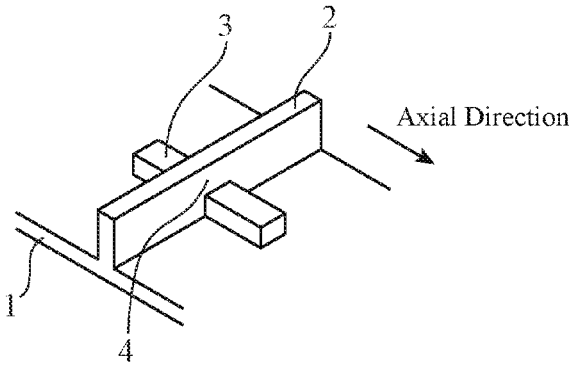
FIG. 7 is an enlarged view showing other configurations of the first protrusion and the second protrusion in Embodiment 1 of the invention.

Each of FIGS. 2 and 5 has shown the case where the height of the adjacent second protrusion 3 is higher than that of the first protrusion 2 at the intersection point 4. However, the invention is not limited thereto and, as shown in FIG. 7, the height of the adjacent first protrusion 2 may be made higher than that of the second protrusion 3 in correspondence to preferable characteristics of the passing phase difference between polarized waves. Further, in the axial direction, the height of the second protrusion 3 may be made higher than that of the first protrusion 2 at a given position, and the height of the first protrusion 2 may be made higher than that of the second protrusion 3 at another position.

In addition, the first and second protrusions 2 and 3 intersect each other, and hence it is possible to change the magnitude of the capacitive or inductive susceptance by the first protrusion 2 not only with the width and height of the first protrusion 2 but also with the width and height of the second protrusion 3. Therefore, an advantageous effect is also achieved that preferable characteristics of the passing phase difference between polarized waves are easily realized.

As described above, according to Embodiment 1, the configuration is adopted in which a plurality of the first protrusions 2 that are provided on one pair of opposing wall surfaces in the waveguide 1, have the longitudinal directions orthogonal to the axial direction of the waveguide 1, and are arranged at intervals along the axial direction, and a plurality of the second protrusions 3 that are provided between the first protrusions 2 on the wall surfaces and are arranged with the longitudinal directions thereof running along the axial direction are provided, and hence preferable frequency characteristics of the passing phase difference between polarized waves are obtained over a wide band in a microwave band or a millimeter wave band without increasing the axial length of the waveguide 1.

Embodiment 2

Figure 8:
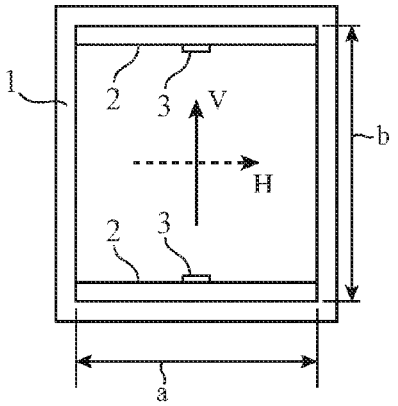
FIG. 8 is a front view showing the configuration of the circularly polarized wave generator according to Embodiment 2 of the invention.

Embodiment 1 has described the case where, as shown in FIGS. 4(*a*) and 4(*b*), each of the opening ends 11 and 12 of the waveguide 1 is formed into the square. In contrast to this, as shown in FIG. 8, each of the opening ends 11 and 12 may also be formed into a rectangle (a:b=1:N). That is, each of the opening ends 11 and 12 is formed into the rectangle in which a direction between the wall surfaces having the first and second protrusions 2 and 3 serves as a longitudinal direction. With this, it is possible to lower the cutoff frequency of the H-polarized wave, and obtain wide-band transmission characteristics. Note that the other configurations and operations of the circularly polarized wave generator according to Embodiment 2 are substantially the same as those in Embodiment 1.

As described above, according to Embodiment 2, since each of the opening ends 11 and 12 is formed into the rectangle, as compared with Embodiment 1, it is possible to lower the cutoff frequency of the H-polarized wave, and obtain wide-band transmission characteristics. As a result, preferable characteristics of the passing phase difference between polarized waves are obtained over a wider band.

Embodiment 3

Embodiment 1 has described the case where, as shown in FIG. 3, in the axial direction, the width of the wall surface in the waveguide 1 (the length of the wall surface provided with the first and second protrusions 2 and 3 perpendicular to the axial direction) is uniform, and the length of the first protrusion 2 in the longitudinal direction is uniform. In contrast to this, as shown in FIG. 9, it may be configured that the length of the first protrusion 2 in the longitudinal direction and the width of the wall surface in the waveguide 1 at each end of the waveguide 1 are different from those at the center in the axial direction.

Figure 9:
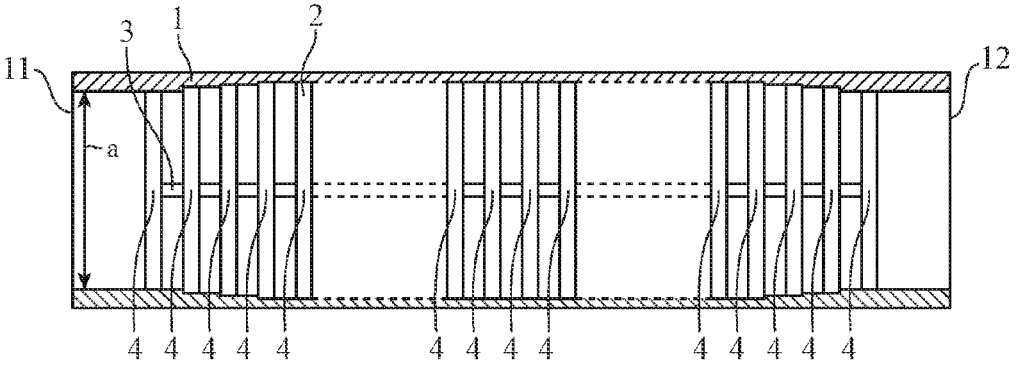
FIG. 9 is a top view showing the configuration of the circularly polarized wave generator according to Embodiment 3 of the invention in which an upper surface is removed.

In an example in FIG. 9, the length of the first protrusion 2 in the longitudinal direction and the width of the wall surface in the waveguide 1 at the center in the axial direction are made longer than an opening dimension a of each of the opening ends 11 and 12. In addition, the length of the first protrusion 2 in the longitudinal direction and the width of the wall surface in the waveguide 1 in the vicinity of each of the opening ends 11 and 12 are formed in a stepwise shape such that they are gradually increased with approach to the center in the axial direction. With this, it is possible to lower the cutoff frequency of the V-polarized wave, and obtain wide-band transmission characteristics. In addition, by gradually enlarging the opening in the vicinity of each of the opening ends 11 and 12 with approach to the center in the axial direction, it is possible to obtain excellent reflection characteristics. Note that the other configurations and operations of the circularly polarized wave generator according to Embodiment 3 are substantially the same as those in Embodiment 1.

As described above, according to Embodiment 3, since it is configured that the length of the first protrusion 2 in the longitudinal direction and the width of the wall surface in the waveguide 1 at each end of the waveguide 1 are different from those at the center in the axial direction, as compared with Embodiment 1, it is possible to lower the cutoff frequency of the V-polarized wave, and obtain wide-band transmission characteristics. As a result, preferable characteristics of the passing phase difference between polarized waves are obtained over a wider band.

Note that FIG. 9 has shown the case where the stepwise shape is provided only in the vicinity of each of the opening ends 11 and 12, but the stepwise shape may also be provided up to the center in the axial direction.

Embodiment 4

Figure 10:
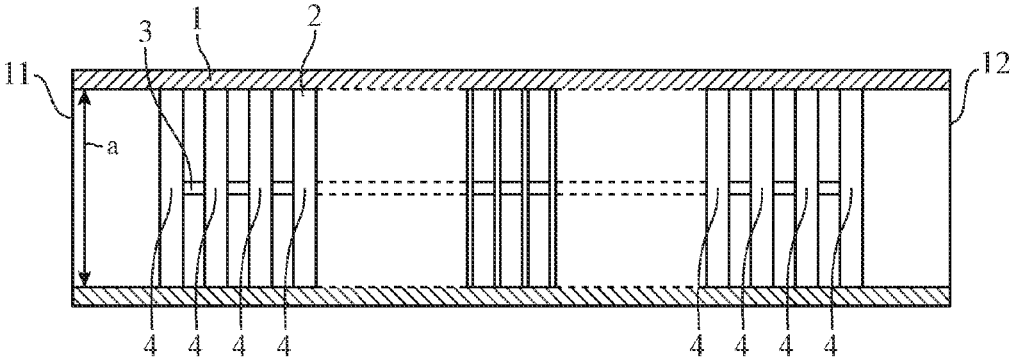
FIG. 10 a top view showing the configuration of the circularly polarized wave generator according to Embodiment 4 of the invention in which an upper surface is removed.

Embodiment 1 has described the case where, as shown in FIG. 3, the thicknesses of all of the first protrusions 2 (the lengths in the axial direction) are equal to each other. In contrast to this, as shown in FIG. 10, the thickness of the first protrusion 2 may be made thinner at the center in the axial direction than that at both ends of the waveguide 1. With this, it is possible to increase the number of design parameters, and obtain characteristics of the passing phase difference between polarized waves over a wide band. Note that the other configurations and operations of the circularly polarized wave generator according to Embodiment 4 are substantially the same as those in Embodiment 1.

As described above, according to Embodiment 4, since it is configured that the thickness of the first protrusion 2 is made thinner at the center in the axial direction than that at both ends of the waveguide 1, as compared with Embodiment 1, it is possible to increase the number of design parameters, and preferable characteristics of the passing phase difference between polarized waves are obtained over a wide band.

Note that FIG. 10 has shown the case where the thickness of the first protrusion 2 is made thinner at the center in the axial direction than that at both ends of the waveguide 1, but the first protrusion 2 may be arranged with any thickness.

In addition, FIG. 10 has shown the case where the arrangement interval of the first protrusions 2 is constant, but the first protrusions 2 may be arranged at any interval.

Embodiment 5

Figure 11:
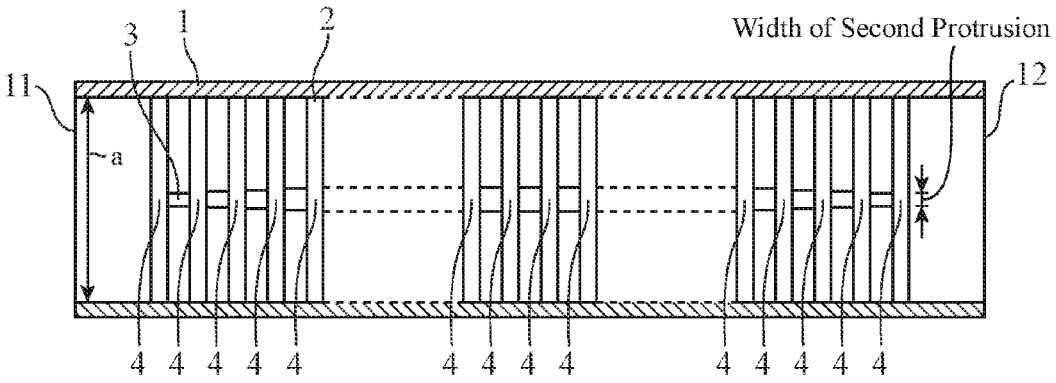
FIG. 11 is a top view showing the configuration of the circularly polarized wave generator according to Embodiment 5 of the invention in which an upper surface is removed.

Embodiment 1 has described the case where, as shown in FIG. 3, the width of the second protrusion 3 (the length perpendicular to the axial direction) is uniform in the axial direction. In contrast to this, as shown in FIG. 11, the widths of the second protrusions 3 may be configured to form the smooth quadratic or cubic Cos curve with the center in the axial direction serving as the vertex. With this, it is possible to change the characteristic impedance of a transmission line having a ridge, and obtain excellent reflection characteristics. In addition, at the same time, by changing the width of the second protrusion 3, it is possible to increase the number of design parameters, and obtain preferable characteristics of the passing phase difference between polarized waves over a wide band. Note that the other configurations and operations of the circularly polarized wave generator according to Embodiment 5 are substantially the same as those in Embodiment 1.

Note that, in the invention of the present application, it is possible to freely combine the embodiments, modify any components of the embodiments, or omit any components in the embodiments within the scope of the invention.

INDUSTRIAL APPLICABILITY

The circularly polarized wave generator according to the invention includes the rectangular hollow waveguide, a plurality of the first protrusions that are provided on one pair of the opposing wall surfaces in the waveguide, have the longitudinal directions orthogonal to the axial direction of the waveguide, and are arranged at intervals along the axial direction, and a plurality of the second protrusions that are provided between the first protrusions on the wall surfaces and are arranged with the longitudinal directions thereof running along the axial direction, and hence preferable frequency characteristics of the passing phase difference between polarized waves are obtained over a wide band without increasing the axial length of the waveguide, and the circularly polarized wave generator is suitably used for communications in the microwave band or the millimeter band.

DESCRIPTION OF REFERENCE NUMERALS AND SIGNS

1: waveguide
2, 3: first and second protrusions
4: intersection point
11, 12: opening end

The invention claimed is:

1. A circularly polarized wave generator comprising:
a rectangular hollow waveguide;
first protrusions that are provided on one pair of opposing wall surfaces in the waveguide, have longitudinal directions orthogonal to an axial direction of the waveguide, and are arranged at an interval along the axial direction; and
second protrusions that are provided between the first protrusions on the opposing wall surfaces and are arranged with longitudinal directions thereof running along the axial direction.

2. The circularly polarized wave generator according to claim 1, wherein
a height of each of the first protrusions is different from a height of each of the second protrusions.

3. The circularly polarized wave generator according to claim 1, wherein
heights of the second protrusions before and after one of the first protrusions positioned adjacent to the second protrusions to be interposed between the second protrusions are different from each other.

4. The circularly polarized wave generator according to claim 1, wherein
an intersection point of a respective one of the first protrusions and a corresponding one of the second protrusions is positioned on a central axis of the waveguide.

5. The circularly polarized wave generator according to claim 1, wherein
heights of the first protrusions and of the second protrusions are configured to form a quadratic or cubic Cos curve with a center of the waveguide in the axial direction serving as a vertex.

6. The circularly polarized wave generator according to claim 1, wherein
each of openings at both ends of the waveguide is formed into a rectangle in which a direction between the opposing wall surfaces serves as the longitudinal direction.

7. The circularly polarized wave generator according to claim 1, wherein
lengths of the first protrusions in the longitudinal direction and widths of the wall surfaces at both ends of the waveguide are different from the lengths of the first protrusions in the longitudinal direction and the widths of the wall surfaces at a center of the waveguide in the axial direction, respectively.

8. The circularly polarized wave generator according to claim 1, wherein
thicknesses of the first protrusions vary or an arrangement of the interval of the first protrusions varies.

9. The circularly polarized wave generator according to claim 1, wherein
widths of the second protrusions are configured to form a quadratic or cubic Cos curve with a center in the axial direction serving as a vertex.

* * * * *